US006996346B2

(12) United States Patent
Ito

(10) Patent No.: US 6,996,346 B2
(45) Date of Patent: Feb. 7, 2006

(54) CONSUMABLE CARTRIDGE HAVING AN INFORMATION RECORDING DEVICE AND CONTROLLER FOR STORING AND SUPPLYING INFORMATION ON THE CARTRIDGE, AND IMAGE FORMING APPARATUS

(75) Inventor: Katsuyuki Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/602,682

(22) Filed: Jun. 25, 2003

(65) Prior Publication Data

US 2004/0120723 A1 Jun. 24, 2004

(30) Foreign Application Priority Data

Dec. 24, 2002 (JP) ..... 2002-372576

(51) Int. Cl.
*G03G 15/00* (2006.01)

(52) U.S. Cl. ..... 399/12

(58) Field of Classification Search ..... 399/12, 399/24, 13, 27
See application file for complete search history.

(56) References Cited

U.S. PATENT DOCUMENTS 5,075,724 A * 12/1991 Wada et al. ..... 399/12
5,634,169 A * 5/1997 Barry et al. ..... 399/12
6,332,062 B1 * 12/2001 Phillips et al. ..... 399/12
6,343,193 B1 1/2002 Matsumoto et al.

FOREIGN PATENT DOCUMENTS

JP 10-133544 5/1998
JP 10161411 A * 6/1998
JP 10198236 A * 7/1998

* cited by examiner

*Primary Examiner*—Quana Grainger
(74) *Attorney, Agent, or Firm*—Rabin & Berdo, PC

(57) ABSTRACT

A consumable cartridge is attached to a mounting portion of a body of a color image forming apparatus and holds a predetermined color developer. The consumable cartridge may take a process cartridge that includes a recording device and a controller. The recording device stores information on the consumable cartridge, the information including at least color information of the color developer. The controller transmits the information to the body of the image forming apparatus. The controller detects whether the consumable cartridge has been attached to the color image forming section. The controller compares the information on the body of image forming apparatus with the information on the consumable cartridge to determine whether the consumable cartridge has been misplaced. If the consumable cartridge has been misplaced, the controller indicates to an operator that the consumable cartridge has been misplaced.

9 Claims, 5 Drawing Sheets

CONSUMABLE CARTRIDGE HAVING AN INFORMATION RECORDING DEVICE AND CONTROLLER FOR STORING AND SUPPLYING INFORMATION ON THE CARTRIDGE, AND IMAGE FORMING APPARATUS

BACKGROUND OF THE INVENTION

1. Field of the Invention

The present invention relates to a consumable cartridge and an image forming apparatus that uses a consumable cartridge.

2. Description of the Related Art

Among conventional color image forming apparatus are printers, copying machines, and facsimile machines. These apparatus are equipped with detachable process cartridges for respective colors. Each process cartridge is a consumable item that is discarded when the developer (e.g., toner) is exhausted, and includes integrally assembled mechanisms that perform an image forming process of a corresponding color. For example, a color electrophotographic printer of the tandem type employs process cartridges for yellow, magenta, cyan, and black images, attached at predetermined positions for forming the respective color images. Toner cartridges of the respective colors may be attached detachably to corresponding process cartridges.

A process cartridge may have a non-volatile memory that records, for example, the number of printed pages and the amount of remaining toner (Japanese Patent Laid Open No. 10-133544).

The deficiency of the conventional process cartridges is that because they are of the same shape regardless of the color of toner held therein, the process cartridges may be misplaced inadvertently.

SUMMARY OF THE INVENTION

The present invention was made to solve the aforementioned drawbacks.

An object of the invention is to provide a consumable cartridge and an image forming apparatus that uses a consumable cartridge, the consumable cartridge and image forming apparatus being of the construction that prevents inadvertent misplacement of cartridges in the image forming apparatus.

A consumable cartridge is attached to a mounting portion of a body of a color image forming apparatus and holds a predetermined color developer. The cartridge includes a recording device and a controller. The recording device stores information on the consumable cartridge, the information including at least color information of the color developer. The controller transmits the information to the body of the image forming apparatus.

The controller of the consumable cartridge detects whether the consumable cartridge has been attached to the image forming section. The controller transmits the information to the body of the image-forming apparatus before the color developer is supplied to the body of the image forming apparatus.

The controller reads the information on the body from the image forming apparatus and the information on the consumable cartridge from the recording device to compare the information on the body with the information on the consumable cartridge to determine whether the consumable cartridge has been misplaced. If the controller determines that the consumable cartridge has been misplaced, the controller indicates to an operator that the consumable cartridge has been misplaced.

The consumable cartridge may be attached to an image forming section of the image forming apparatus.

The consumable cartridge may be attached to a body of a process cartridge attached to the image forming apparatus.

A consumable cartridge is attached to a mounting portion of a body of an image forming apparatus and holds a predetermined color developer. The consumable cartridge includes a recording device and a control section. The recording device stores information of on the consumable cartridge, the information including at least color information of the color developer. The controller transmits the information to the body of the image forming apparatus.

An image forming apparatus includes the aforementioned consumable cartridge.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DESCRIPTION OF THE INVENTION

First Embodiment

Embodiments of the invention will be described with reference to the accompanying drawings.

Figure 1:
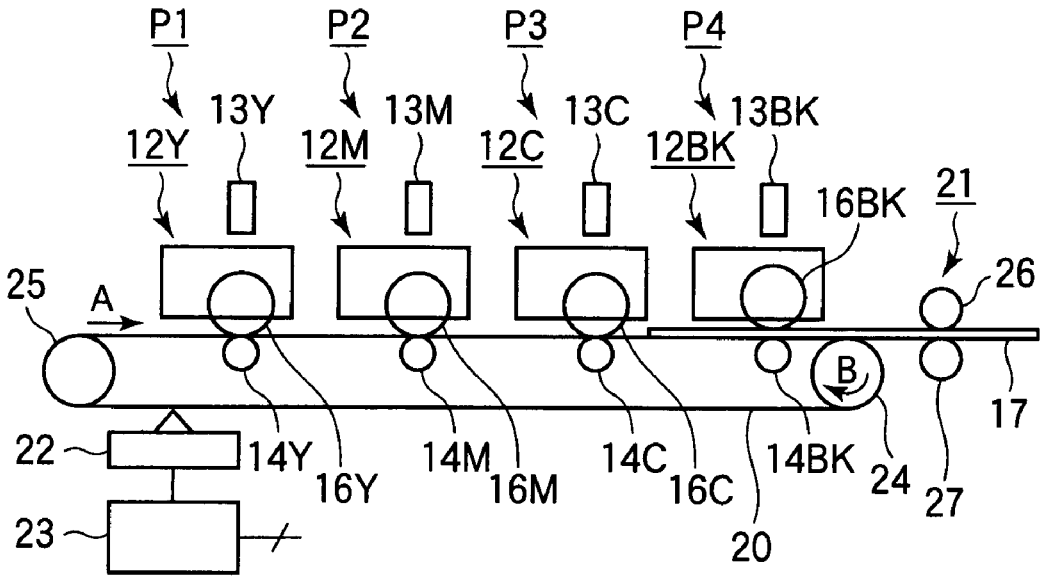
FIG. 1 illustrates the general configuration of a color electrophotographic printer of the tandem type according to a first embodiment of the present invention.

FIG. 1 illustrates the general configuration of a color electrophotographic printer of the tandem type according to a first embodiment of the present invention.

Referring to FIG. 1, a drive pulley 24 and a driven pulley 25 are spaced apart by a predetermined distance and a transfer belt is mounted on the drive pulley 24 and driven pulley 25. When the drive pulley 24 is driven in rotation in a direction shown by arrow B by an external drive source, not shown, the transfer belt 20 runs in a direction shown by arrow A to transport paper 17.

Image forming sections P1 to P4 are aligned along a transport path of the paper 17 so as to form yellow, magenta, cyan, and black images. Process cartridges 12Y, 12M, 12C, and 12BK are detachably attached to the corresponding image forming sections P1 to P4. The process cartridges 12Y, 12M, 12C, and 12BK include corresponding rotatable photoconductive drums 16Y, 16M, 16C, and 16BK, and hold yellow, magenta, cyan, and black toners.

The process cartridges 12Y, 12M, 12C, and 12BK also include LED heads 13Y, 13M, 13C, and 13BK that oppose the photoconductive drums 16Y, 16M, 16C, and 16BK, respectively. Transfer rollers 14Y, 14M, 14C, and 14BK are disposed so that the transfer belt 20 is sandwiched between the transfer rollers 14Y, 14M, 14C, and 14BK and the photoconductive drums 16Y, 16M, 16C, and 16BK. The LED heads 13Y, 13M, 13C, and 13BK illuminate the surfaces of the photoconductive drums 16Y, 16M, 16C, and 16BK, respectively, to form electrostatic latent images of yellow, magenta, cyan, and black, respectively. Then, yellow, magenta, cyan, and black toners are deposited to the respective electrostatic latent images, thereby developing the electrostatic latent images into toner images of the respective colors. Then, the toner images of the respective colors are transferred onto the paper 17 sequentially in registration with one another as the paper 17 is transported on the belt 20 along the transport path.

A fixing unit 21 is disposed downstream of the drive pulley 24 with respect to the transport path of the paper 17. The fixing unit 21 includes a heat roller 26 and a pressure roller 27. The toner images of the respective colors on the paper 17 are fused at the fixing unit 21 into a permanent full color image. A detection section 22 is disposed shortly upstream of the driven roller 25 and opposes the transfer belt 20. The detection section 22 includes a light-emitting element and a light-receiving sensor, not shown.

In a test mode, the toner images of the respective colors are transferred from the photoconductive drums 16Y, 16M, 16C, and 16BK directly onto the transfer belt 20 to form a test image pattern for test printing. The detection section 22 reads the test image pattern, so that color information on the respective colors developers such as color shift, image density, hue, $\gamma$ characteristic of the respective colors are detected for the process cartridges 12Y, 12M, 12C, and 12BK and the detection results are sent as detection information to a print controller 23.

The print controller 23 reads the detection information and determines based on the detection information whether color shift, image density, hue, and $\gamma$ characteristic are within predetermined ranges, thereby determining whether an abnormal condition has occurred. The print controller 23 stores the detection information into corresponding recording sections 33 in the process cartridges 12Y, 12M, 12C, and 12BK. The print controller 23 performs overall control of the color electrophotographic printer for printing.

The operation of the process cartridges 12Y, 12M, 12C, and 12BK attached to the image forming sections P1-P, respectively, will now be described. The process cartridges 12Y, 12M, 12C, and 12 operate in the same manner and therefore only the process cartridge 12Y for yellow will be described by way of example.

Figure 2:
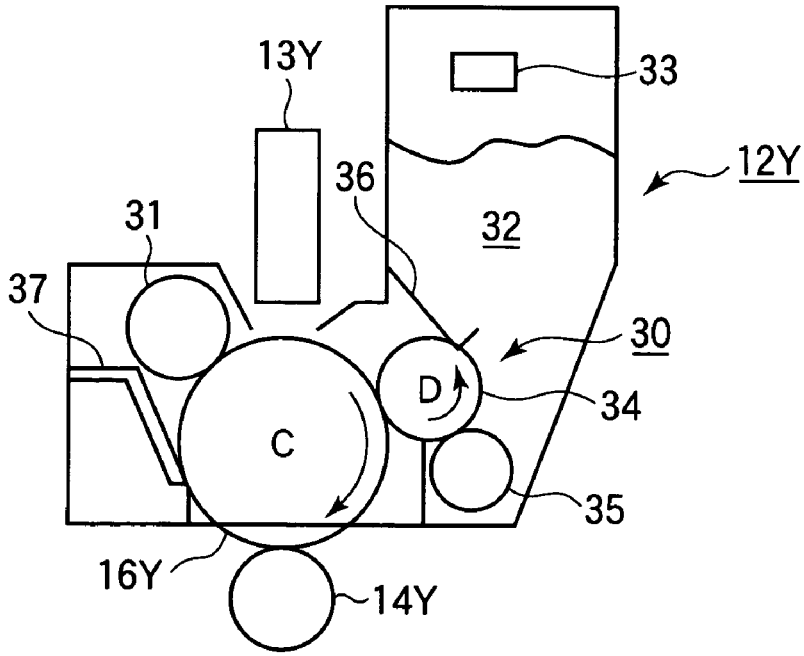
FIG. 2 illustrates an outline of a yellow process cartridge according to a first embodiment.

FIG. 2 illustrates an outline of a yellow process cartridge 12Y according to a first embodiment.

Referring to FIG. 2, the process cartridge 12Y is of integral construction. The photoconductive drum 16Y rotates in a direction shown by arrow C. A charging roller 31, the LED head 13Y, a developing unit 30, the transfer roller 14Y, and a cleaning blade 37 are disposed around the photoconductive drum 16Y. The developing unit 30 holds toner 32 therein and includes a developing blade 36, a developing roller 34 that rotates in a direction shown by arrow D, and a toner-supplying roller 35. Because the process cartridge 12Y is a consumable item and cannot be refilled with the toner 32, the process cartridge 12Y is replaced in its entirety when the toner 32 is exhausted.

Figure 3:
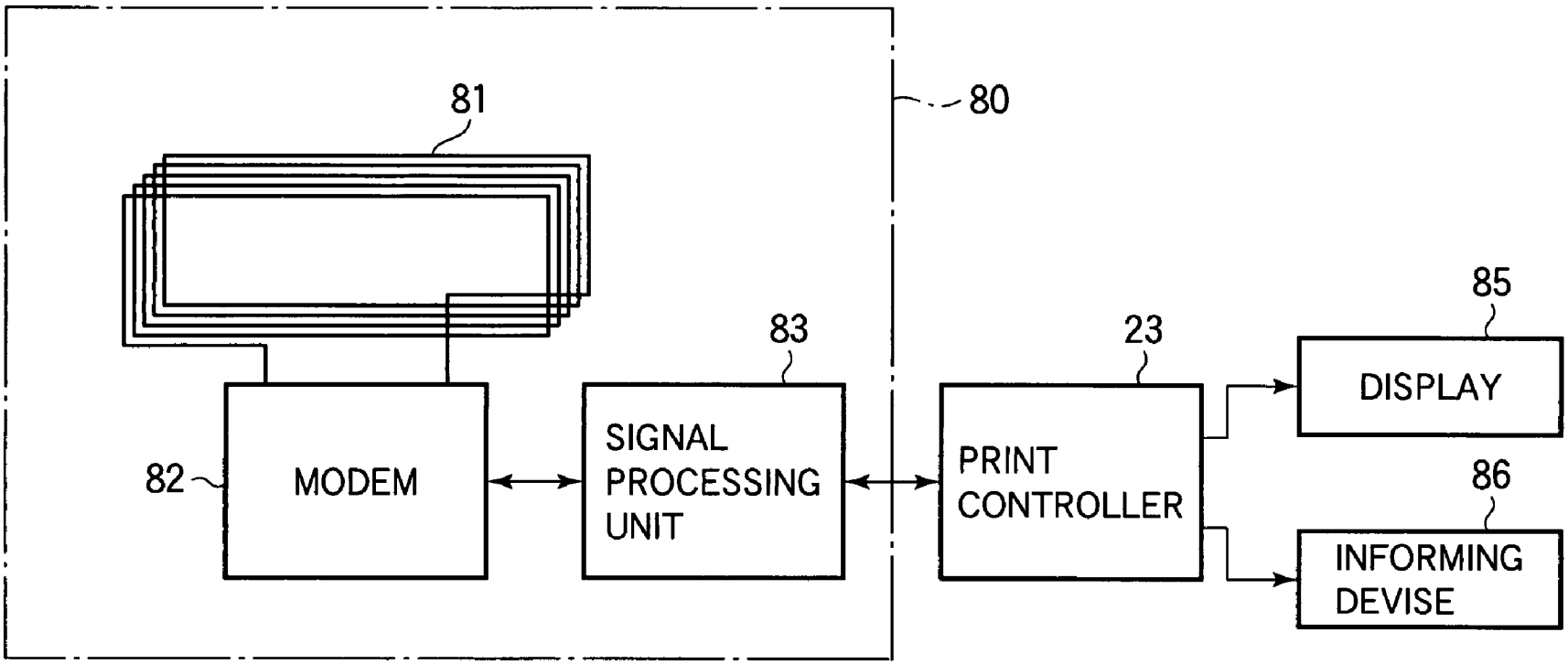
FIG. 3 illustrates a read/write device.
Figure 5:
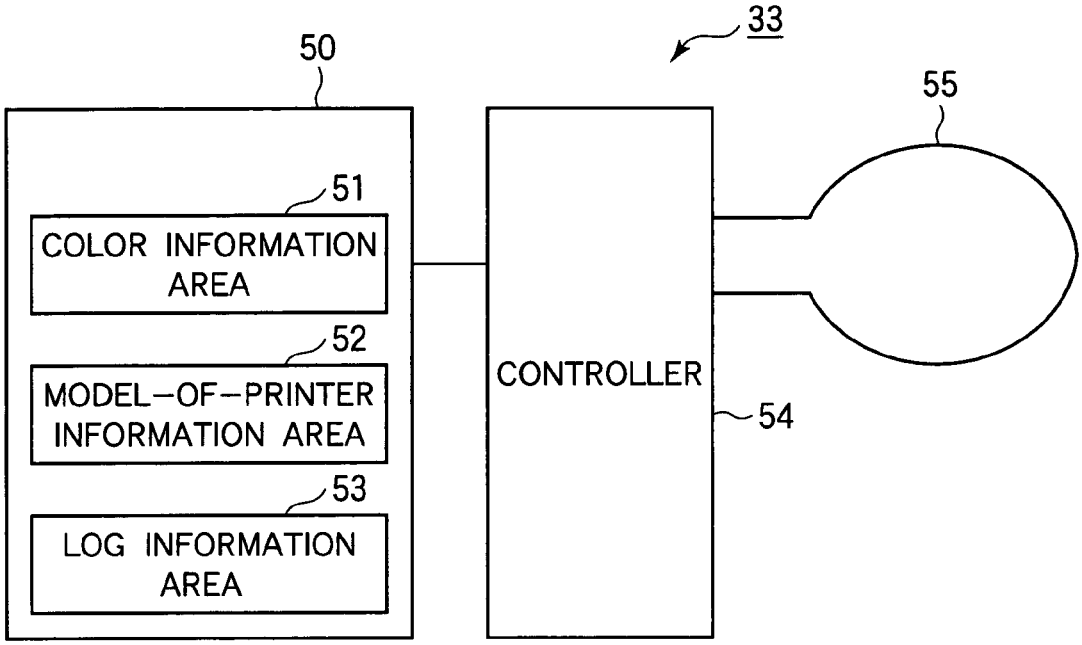
FIG. 5 is a block diagram of a recording section according to the first embodiment.
Figure 8:
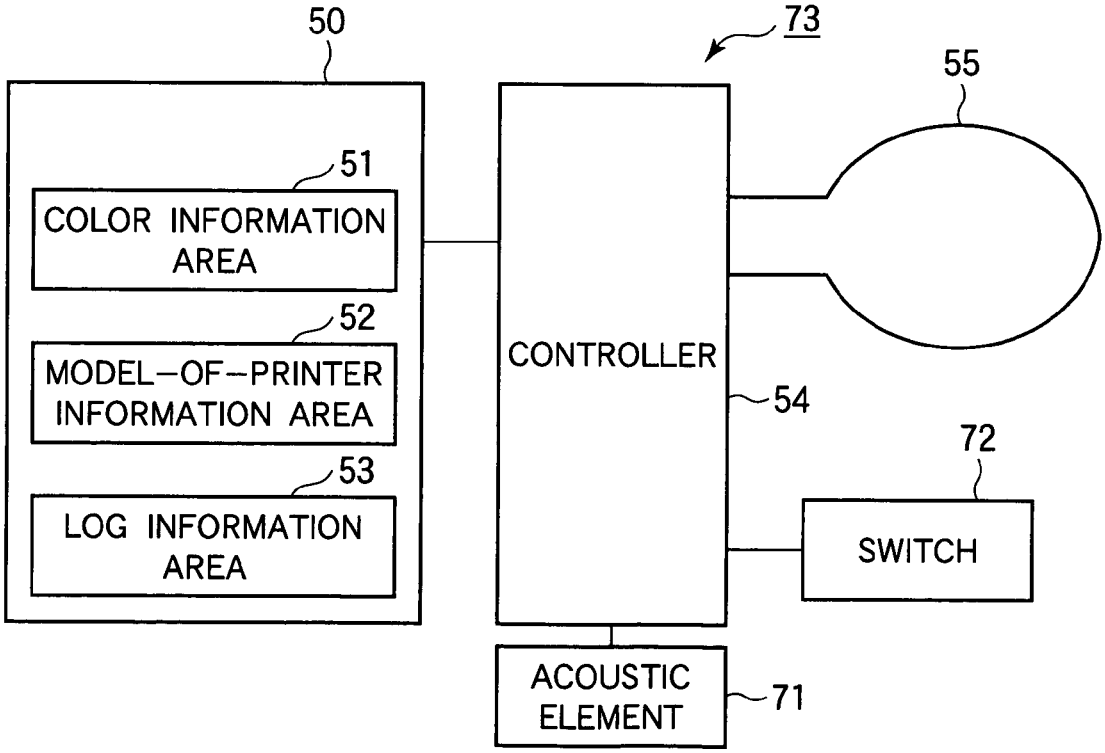
FIG. 8 is a block diagram of a recording section according to a fourth embodiment.

FIG. 3 illustrates a read/write device. The process cartridge 12Y has a recording device 33 connected to a loop antenna 55 (FIGS. 5 and 8). The electrophotographic printer has a read/write device 80 that incorporates an antenna coil 81, a modem 82, and a signal-processing unit 83. The signal-processing unit 83 is connected to the print controller 23 of the body of the electrophotographic printer, so that information is displayed on a display 85 of the printer or radiated through an informing device 86.

The antenna coil 81 transmits a magnetic field in accordance with a modulation signal supplied from the modem 82, and receives a magnetic field generated by the loop antenna 55 on the process cartridge 12Y. The modem 82 demodulates a signal received from the recording device 33 via the loop antenna and the antenna coil 81, and then outputs the demodulated data to the signal-processing unit 83. The modem 82 modulates a carrier frequency with the data supplied from the signal-processing unit 83 and feeds the modulated carrier frequency to the antenna coil 81.

The signal-processing unit 83 performs various signal processing under the control of a built-in program. For example, the signal-processing unit 83 modulates the data to be transmitted to the process cartridge 12Y, and outputs the modulated data to the modem 82.

The print control circuit 23 displays the data on the display 85. As described above, when the process cartridge 12Y transmits data via the loop antenna 55, the voltage induced in the antenna coil 81 varies in accordance with the change in magnetic field generated by the loop antenna on the process cartridge 12Y. Thus, the read/write device 80 receives the data from the process cartridge.

The read/write device 80 radiates a predetermined magnetic field from the antenna coil 81 to detect a change in load on the antenna coil 81. Once the process cartridge 12Y is attached properly into the printer, the loop antenna 55 is sufficiently close to the antenna coil 81. This means that the antenna coil 81 has been coupled with the loop antenna properly, and the read/write device 80 is ready to communicate with the recording device 33. The read/write device 80 may intermittently radiate a magnetic field modulated with data of a short pattern until a response is obtained from the loop coil 55.

By using the aforementioned read/write device 80, the print controller 23 can write data into the recording device 33 and read data from the recording device 33 once the process cartridge 12Y has been attached into the process cartridge 12Y on the printer body. The data is written into the recording device 33 and read from the recording device 33 by using a recognition technique (referred to as RF-ID) that employs a radio frequency. For this purpose, the loop antenna 55 provided on the process cartridge 12Y and the antenna coil 81 provided on the printer body face each other and are spaced apart by a predetermined distance. Then, an a-c signal current is supplied to the coils, so that magnetic fields are induced in the loop antenna 55 and antenna coil 81 to establish communication between the two antenna coils.

The charging roller 31 charges the surface of the photoconductive drum 16Y uniformly. Then, the LED head 13Y illuminates the charged surface of the photoconductive drum 16Y to form an electrostatic latent image on the surface. Then, the developing unit 30 develops the electrostatic latent image into a toner image. The toner-supplying roller 35 supplies the toner 32 held in the developing unit 30 to the developing roller 34, and the developing blade 36 forms a thin layer of toner 32 on the developing roller 34. The layer of toner 32 is supplied to the electrostatic latent image so as to form a toner image on the photoconductive drum 16Y.

Then, the toner image is transferred by the transfer roller 14Y onto the print paper 17. The cleaning blade 37 scrapes residual toner 32 from the photoconductive drum 16Y.

The operation of the color electrophotographic printer of the aforementioned configuration will now be described.

Figure 4:
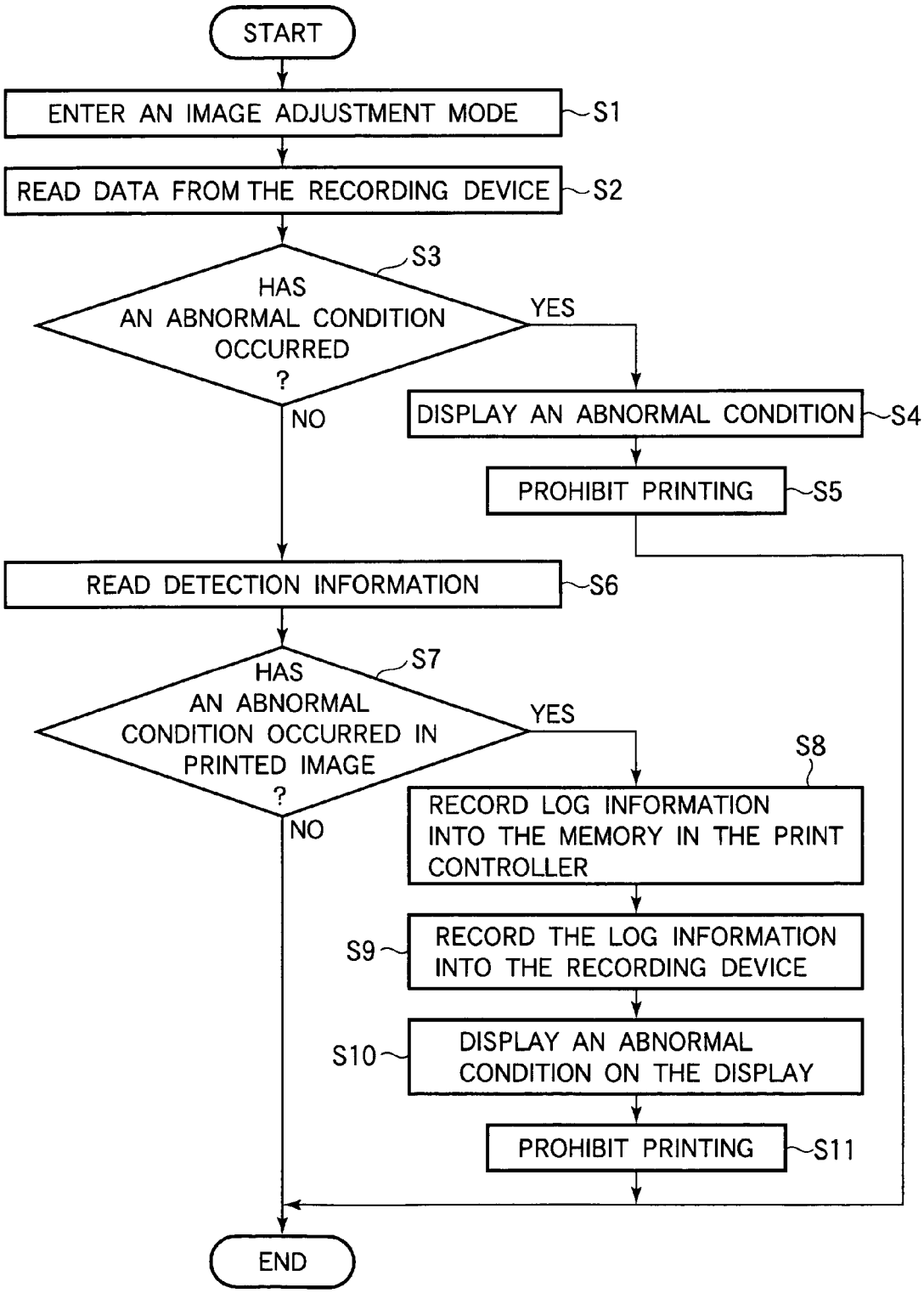
FIG. 4 is a flowchart, illustrating the operation of the color electrophotographic printer according to the first embodiment.

FIG. 4 is a flowchart, illustrating the operation of the color electrophotographic printer according to the first embodiment.

When the color electrophotographic printer is turned on or enters an image adjustment mode at intervals of the predetermined number of printed pages (S1), the print controller 23 (FIG. 1) reads data from the recording device 33 (S2) via the read/write device 80. The data in the recording device 33 describes color information such as image density, hue, and γ characteristic of the respective colors in addition to printer type information such as the model of color electrophotographic printer, information on the color of toner held in the printer, and log information specific to an individual printer in use. The information on the type of the printer is stored into the recording device 33 during the manufacture of the color electrophotographic printer while the log information of an individual printer and color information is stored after the printer begins to be used.

The print controller 23 reads information from the recording device 33 and determines based on the information whether an abnormal condition has occurred (S3). If an abnormal condition has occurred, then the print controller 23 causes the display 85 to indicate to the user that an abnormal condition has occurred in any one of the process cartridges 12Y, 12M, 12C, and 12BK. The display 85 also displays the specific abnormal condition (S4). Then, the print controller 23 prohibits the operation of the color electrophotographic printer (S5). Thus, the print controller 23 ignores a subsequent print command and enters a subsequent error handling operation.

If no abnormal condition has occurred in any one of the process cartridges 12Y, 12M, 12C, and 12BK, then the print controller 23 reads the detection information from the detection section 22 (S6) and determines based on the detection information whether color shift, image density, hue, and γ characteristic of the respective colors are within predetermined ranges, thereby determining whether an image has been formed normally, in other words, whether an abnormal condition has occurred (S7). For this purpose, in the image adjustment mode, a test image pattern is formed on the transfer belt 20. The test image pattern is read by the detection section 22 to detect color information on the respective color developer such as color shift, image density, hue, γ characteristic of the respective colors for the respective process cartridges 12Y, 12M, 12C, and 12BK.

If the items of respective detection information are within corresponding predetermined ranges and therefore no abnormal condition has occurred, the print controller 23 initiates printing. If the items of respective detection information is not within corresponding predetermined ranges, then it is determined that an abnormal condition has occurred. Thus, the print controller 23 records the occurrence of an abnormal condition, the date and time of the occurrence of the abnormal condition, and the specific abnormal condition into a memory in the print controller 23 and then into the recording device 33 (S8).

The print controller 23 also causes the display 85 to display the occurrence of abnormal condition and the specific abnormal condition (S10), and then stops the operation of the color electrophotographic printer to prohibit printing (S11).

If the items of detection information fall in predetermined ranges after eliminating the abnormal condition so that images can be normally formed, the print controller 23 performs an error recovery operation in which the abnormal condition is removed. In accordance with the error recovery operation, information such as the removal of abnormal condition and the date and time of recovery from the abnormal condition is stored into the memory in the print controller 23 and the recording device 33. Then, the print controller 23 resumes printing. Alternatively, even when the printer has recovered from an abnormal condition so that an image can be formed normally, the print controller 23 may not resume printing but enters the next operation in response to a command of removing an abnormal condition.

The flowchart will be described.

Step S1: Enter an image adjustment mode.

Step S2: Read data from the recording device 33.

Step S3: Determine whether an abnormal condition has occurred.

Step S4: Display an abnormal condition

Step S5: Prohibit printing

Step S6: Read detection information

Step S7: Determine whether an abnormal condition has occurred. If an abnormal condition has occurred, then proceed to step S8, if no abnormal condition has occurred, then terminate the abnormal detection operation Step S8: Record log information into the memory in the print controller 23

Step S9: Record the log information into the recording device 33

Step S10: Display information on an abnormal condition on the display

Step S11: Prohibit printing

The recording device 33 will be described.

FIG. 5 is a block diagram of the recording device 33 according to the first embodiment.

Referring to FIG. 5, the recording device 33 includes an information memory 50, and a controller 54, and the loop antenna 55. The information memory 50 stores at least color information of the items of information on the model of printer, log information, and color information. The controller 54 performs the overall control of the recording device 33. The loop antenna 55 is used for transmitting signals to and receiving signals from the antenna coil 81 provided in the read/write device 80 on the printer body. The information memory 50 includes a color information area 51, the model-of-printer area 52, and a log information area 53. The information memory 50 takes the form of a rewritable non-volatile memory. When the information memory 50 is to store all of the model-of-printer information, log information, and color information, the information memory 50 can take the form of, for example, an EEPROM, a battery-backed up memory, or a flash memory. When the information memory 50 is to store only the color information, the information memory 50 can take the form of, for example, a mask ROM, or an EEPROM.

The information memory 50 is connected to the controller 54, and the controller 54 controls the loop antenna 55 and an I/O. The controller 54 has a power supply that supplies electric power to the controller 54 and the information memory 50 by way of induced current supplied via the loop antenna 55.

The controller 54 performs control so that when the process cartridges 12Y, 12M, 12C, and 12BK have been attached to the image forming sections P1–P4, electric power is generated by the current induced through the loop antenna 55 from the printer body. The controller 54 performs control only when the process cartridges 12Y, 12M, 12C, and 12BK have been attached to the image forming sections P1–P4 properly. The controller 54 transmits the model-of-printer information, log information, and color information to the printer body. When the process cartridges 12Y, 12M, 12C, and 12BK have been misplaced, the controller 54 does not perform control and does not send the information, i.e., the model-of-printer information, log information, and color information to the printer body. As a result, the print controller 23 cannot read the data from the recording device 33 and therefore determines that at least one of the process cartridges 12Y, 12M, 12C, and 12BK has abnormal conditions.

In the present embodiment, upon simply attaching the process cartridges 12Y, 12M, 12C, and 12BK to the image forming sections of the printer, it can be determined whether an abnormal condition has occurred. Therefore, the embodiment prevents inadvertent misplacement of the process cartridges 12Y, 12M, 12C, and 12BK, so that the toners of different colors can be prevented from being mixed.

The embodiment eliminates the possibility of a defective process cartridge being used, preventing damage to the printer body. The occurrence of an abnormal condition, date and time of the occurrence, and the specific abnormal condition are recorded in the log information area 53, so that the cause of the abnormal condition can be determined as well as the maintenance of the electrophotographic printer can be improved.

Second Embodiment

Figure 6:
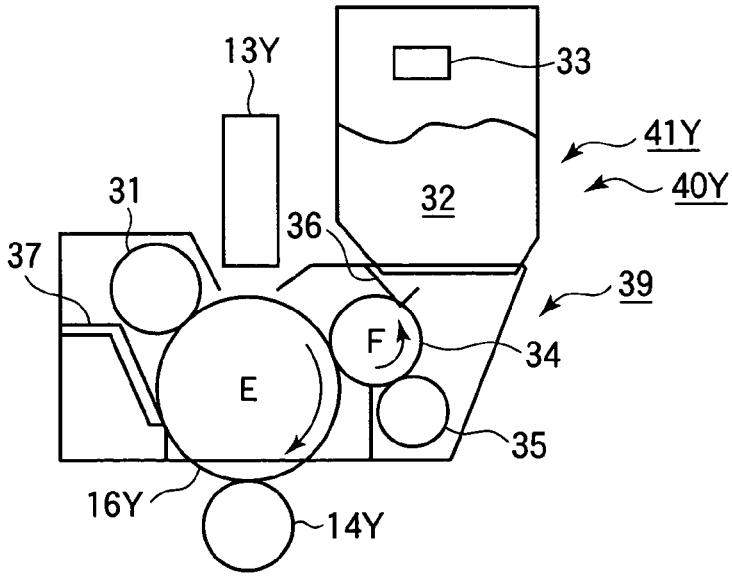
FIG. 6 illustrates an outline of a process cartridge for yellow that can be replaced.

A second embodiment uses a process cartridge in which a toner cartridge can be replaced. FIG. 6 illustrates an outline of a process cartridge for yellow that can be replaced. The process cartridges 40Y, 40M, 40C, and 40BK are of the same construction and therefore the process cartridge 40Y for yellow will be described by way of example.

As shown in FIG. 6, the process cartridge 40Y is provided with a toner cartridge 41Y that is detachably mounted to a body 39 of the process cartridge 40Y. The toner cartridge 41Y holds the toner 32 therein and has the recording device 33. The process cartridge 40Y is attached to a body of a color electrophotographic printer of the tandem type.

The body 39 of the process cartridge 40Y includes a photoconductive drum 16Y that rotates in the direction shown by arrow E. A charging roller 31, an LED head 13Y, a developing unit 30, a transfer roller 14Y, and a cleaning blade 37 are disposed around the photoconductive drum 16Y. The developing unit 30 holds the toner 32 therein and includes a developing blade 36, a developing roller 34, and a toner-supplying roller 35. The developing roller 34 rotates in a direction shown by arrow F and deposits the toner 32 to an electrostatic latent image formed on the photoconductive drum 16Y. The toner-supplying roller 35 supplies the toner 32 to the developing roller 34. The process cartridge 40Y is designed such that toner 32 can be replenished. Thus, when the toner 32 is exhausted, the toner cartridge 41Y can be replaced.

When the toner cartridge 41Y is attached to the body 39 and the process cartridge 40Y is attached to the printer body, the print controller 23 becomes ready to write data into and read data from the recording device 33.

The operation of a color electrophotographic printer of the aforementioned construction will now be described.

When the color electrophotographic printer is turned on or enters the image adjustment mode at predetermined intervals of printed pages, the print controller 23 reads the data from the recording device 33. The data in the recording device 33 includes color information such as image density, hue, and γ characteristic of the respective colors, in addition to the information such as the color of toner 32 and log information of the printer. The color of toner is stored in the recording device 33 during the manufacture of the printer, while the log information and color information are stored in the course of use of the printer.

The print controller 23 reads information from the recording device 33 and determines based on the information whether an abnormal condition has occurred in any one of the process cartridges 40Y, 40M, 40C, and 40BK. If an abnormal condition has occurred, then the print controller 23 causes the display 85, not shown, to indicate to the user that an abnormal condition has occurred in at lest in one of the process cartridges 12Y, 12M, 12C, and 12BK. The display 85 also displays the specific abnormal condition. Then, the print controller 23 prohibits the operation of the color electrophotographic printer, thereby halting printing. The print controller 23 ignores a subsequent print command and enters a subsequent error handling operation.

If no abnormal condition has occurred in the process cartridges 40Y, 40M, 40C, and 40BK, the print controller 23 reads the detection information from the detecting section 22 and determines based on the detection information whether items of color information such as color shift, image density, hue, and γ characteristic of the respective color are within predetermined ranges, thereby determining whether an image has been formed normally, in other words, whether an abnormal condition has occurred. For this purpose, in the image adjustment mode, a test image pattern is formed on the transfer belt 20. The test image pattern is read by the detection section 22 to detect color information on the respective color developer, color shift, image density, hue, γ characteristic of the respective colors for the respective process cartridges 12Y, 12M, 12C, and 12BK.

If the respective items of detection information are within corresponding predetermined ranges and therefore no abnormal condition has occurred, the print controller 23 initiates printing. If the respective items of detection information are not within the corresponding predetermined ranges, it is determined that images are not formed properly. Thus, the print controller 23 records log information such as the occurrence of abnormal condition, date and time of the occurrence of the abnormal condition, and the specific abnormal condition into the memory in the print controller 23 and then into the recording device 33.

The print controller 23 also causes the display 85 to display the occurrence of abnormal condition, and the specific abnormal condition. The print controller 23 then stops the operation of the color electrophotographic printer, thereby prohibiting printing.

Just as in the first embodiment, a controller 54 (FIG. 5) is provided in the recording device 33. The controller 54 performs control so that when the process cartridges 40Y, 40M, 40C, and 40BK have been attached to the image forming sections P1–P4, electric power is generated by the current induced through the loop antenna 55 from the printer body. The controller 54 performs control only when the process cartridges 40Y, 40M, 40C, and 40BK have been attached to the image forming sections P1–P4 properly and the toner cartridges 41Y, 41M, 41C, and 41BK have been attached to the process cartridges. The information transmitter, not shown, of the controller 54 transmits the model-of-printer information, log information, and color information to the printer body. For example, when the process cartridges 40Y, 40M, 40C, and 40BK have been misplaced and/or the toner cartridges 41Y, 41M, 41C, and 41BK have been misplaced, the controller 54 does not perform further control. The controller 54 does not send the information such as model-of-printer information, log information, and color information to the printer body. As a result, the print controller 23 cannot read the data from the recording device 33 and therefore determines that the process cartridges 40Y, 40M, 40C, and 40BK have abnormal conditions and/or the toner cartridges 41Y, 41M, 41C, and 41BK have abnormal conditions.

In the present embodiment, by simply attaching the process cartridges 40Y, 40M, 40C, and 40BK to the image forming sections P1–P4 of the printer, it can be determined whether an abnormal condition has occurred. Therefore, the embodiment prevents inadvertent misplacement of the process cartridges 40Y, 40M, 40C, and 40BK and the toner cartridges 41Y, 41M, 41C, and 41BK, so that the toners of different colors can be prevented from being mixed.

The embodiment eliminates the possibility of a defective process cartridge being used, preventing damage to the printer body. In the second embodiment, because the recording device 33 is provided in each of the toner cartridges 41Y, 41M, 41C, and 41BK, the information stored in the recording device 33 is discarded together with the toner cartridge when the toner cartridge is replaced. Therefore, upon replacement of any one of the toner cartridge 41Y, 41M, 41C, and 41BK, the print controller 23 stores the color information and log information into the recording device 33 of a newly attached toner cartridge and the number of accumulated times the toner cartridge is replaced.

Third Embodiment

A third embodiment has a feature that information is transmitted and received between the print controller 23 and the toner cartridge through an I/O interface and not through a radio frequency.

Figure 7:
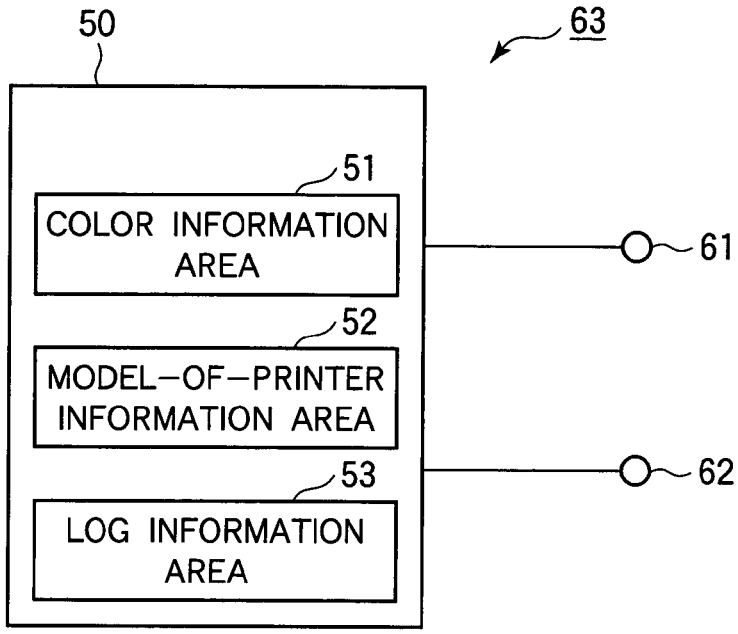
FIG. 7 is a block diagram of a recording section according to a third embodiment.

FIG. 7 is a block diagram of a recording device 63 according to a third embodiment.

A recording device 63 includes an information memory 50, which is connected to the print controller 23 through a signal I/O terminal 61, and to a power supply through a power supply terminal 62. The print controller 23 writes data into the recording device 63 and reads data from the recording device 63 through the signal I/O terminal 61.

Fourth Embodiment

FIG. 8 is a block diagram of a recording device 73 according to a fourth embodiment.

A recording device 73 takes the form of a chip that includes an information memory 50, controller 54, a loop antenna 55, an acoustic element 71, and a switch 72 therein.

When the process cartridges 12Y, 12M, 12C, and 12BK (FIG. 1) are attached to the image forming sections P1–P4, the switch 72 turns on. Then, the controller 54 performs a detecting operation in which the controller 54 detects that the process cartridges 12Y, 12M, 12C, and 12BK have been attached to the image forming sections P1–P4, respectively. The print controller 54 transmits the data to the printer body before the toner 32 (FIG. 2) is supplied to the printer body.

Then, the controller 54 performs a misplacement detecting operation in which the controller 54 reads the color information from the printer body and the color information from a color information area 51 of the recording device 73. The controller 54 then determines based on these two items of information whether these two items of information coincide with each other, thereby determining whether the process cartridges 12Y, 12M, 12C, and 12BK have been attached properly. If the two items of information differ from each other, the controller 54 performs an alarm operation in which the controller 54 causes the acoustic element 71 to generate informing sound. In this manner, the operator is informed that the process cartridges 12Y, 12M, 12C, and 12BK have been misplaced.

The acoustic element 71 takes the form of, for example, a piezoelectric loud speaker that receives a pulse signal of an audible frequency and generates the informing sound. An optical element such as LEDs may be used in place of the acoustic element 71.

In the fourth embodiment, the color information is read from the printer body and the color information area 51. Alternatively, the model-of-printer information may be read from the printer body the color information area 51, thereby subsequently comparing the two items of information may be compared with each other to determine whether the consumable cartridge has been misplaced.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A consumable cartridge that is attachable to a mounting portion of a body of a color image forming apparatus and holds a predetermined color developer, comprising:

a recording device, storing first information on the consumable cartridge, the first information including at least color information of the color developer; and a controller, transmitting the first information to the body of the image forming apparatus;

wherein said controller reads second information on the body from the image forming apparatus and determines based on the first information and second information whether the consumable cartridge has been misplaced on the mounting portion; and wherein if said controller determines that the consumable cartridge has been misplaced, said controller indicates to an operator that the consumable cartridge has been misplaced.

2. A color image forming apparatus including a body, and a consumable cartridge that is attachable to a mounting portion in the body and that holds a predetermined color developer, wherein the consumable cartridge comprises:

a recording device that stores information on the consumable cartridge, the information including at least color information on the color developer;

a first controller that controls transmission of the information to the body of the image forming apparatus;

a first antenna, physically separated from the body and coupling the consumable cartridge to the body by electromagnetic induction;

wherein the body of the image forming apparatus comprises:

a read-and-write device, having a second antenna that is physically separated from the consumable cartridge and couples the body to the consumable cartridge by the electromagnetic induction, said read-and-write device reading the information stored in said recording device;

a second controller that outputs a signal that prevents printing when said second controller determines, based on the information, that the consumable cartridge is misplaced; and and an informing section that indicates an abnormality when said second controller determines that the consumable cartridge is misplaced;

wherein the image forming apparatus communicates with the consumable cartridge through the first antenna and the second antenna so that electric power is supplied from the body to said recording device and said first controller through the first antenna and the second antenna and the information is transmitted through said first antenna and the second antenna.

3. The color image forming apparatus according to claim 2, wherein the consumable cartridge is attached to an image forming section of the image forming apparatus.

4. The color image forming apparatus according to claim 2, wherein the consumable cartridge is attached to a body of a process cartridge attached to the color image forming apparatus.

5. The color image forming apparatus according to claim 2, wherein the apparatus receives the consumable cartridge in a consumable cartridge receiving portion.

6. A color image forming apparatus including a body, and a consumable cartridge that is attachable to a mounting portion in the body and that holds a predetermined color developer, wherein the consumable cartridge comprises:

a recording device that stores a first item of information on the consumable cartridge, the first item of information including at least color information, the color information including image density, hue, and $\gamma$ characteristics of the color developer;

a first controller that controls transmission of the first item of information to the body of the image forming apparatus;

a first antenna, physically separated from the body and coupling the consumable cartridge to the body by electromagnetic induction;

wherein the body of the image forming apparatus comprises:

a read-and-write device, reading the first item of information stored in said recording device and having a second antenna physically separated from the consumable cartridge and coupling the body to the consumable cartridge by the electromagnetic induction;

a transfer belt;

a detector that detects an image test pattern formed on said transfer belt;

a second controller that outputs a signal that prevents printing when said second controller detects an abnormality based on at least one of the first item of information and a second item of information on a color of the image test pattern; and an informing section that indicates the abnormality;

wherein the image forming apparatus communicates with the consumable cartridge through the first antenna and the second antenna so that electric power is supplied from the body to said recording device and said first controller through the first antenna and the second antenna and the first item of information is transmitted through the first antenna and the second antenna.

7. The color image forming apparatus according to claim 6, wherein the consumable cartridge is attached to an image forming section of the image forming apparatus.

8. The color image forming apparatus according to claim 6, wherein the consumable cartridge is attached to a body of a process cartridge attached to the color image forming apparatus.

9. The color image forming apparatus according to claim 6, wherein the apparatus receives the consumable cartridge in a consumable cartridge receiving portion.

* * * * *